US007303245B2

(12) United States Patent
Kunihiro

(10) Patent No.: US 7,303,245 B2
(45) Date of Patent: Dec. 4, 2007

(54) PRINTING APPARATUS, PRINTING SYSTEM AND CONTROL METHOD FOR PRINTING APPARATUS

(75) Inventor: Shunichi Kunihiro, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 175 days.

(21) Appl. No.: 10/769,372

(22) Filed: Jan. 29, 2004

(65) Prior Publication Data

US 2004/0183841 A1 Sep. 23, 2004

(30) Foreign Application Priority Data

Jan. 31, 2003 (JP) ..... 2003-024321

(51) Int. Cl.
*B41J 29/38* (2006.01)
*B41J 29/393* (2006.01)

(52) U.S. Cl. ..... 347/5; 347/19

(58) Field of Classification Search ..... 347/19
See application file for complete search history.

(56) References Cited

U.S. PATENT DOCUMENTS 5,988,784 A 11/1999 Takemura et al.
6,267,519 B1 * 7/2001 Otsuki et al. ..... 400/283
6,318,827 B1 * 11/2001 Brenner et al. ..... 347/9
6,429,886 B2 * 8/2002 Ohki ..... 347/115
6,527,360 B2 3/2003 Otsuki et al. ..... 347/19
6,775,022 B2 * 8/2004 Noyes et al. ..... 358/1.15
6,921,218 B2 * 7/2005 Moriyama et al. ..... 400/62
2003/0035021 A1 2/2003 Masuyama et al.
2004/0080554 A1 4/2004 Kim ..... 347/12

FOREIGN PATENT DOCUMENTS

EP 1 078 771 2/2001
JP 2001-129985 5/2001

OTHER PUBLICATIONS

U.S. Appl. No. 10/767,716, filed Jan. 30, 2004, "Inkjet Printing Apparatus and Control Method for the Same".
Notice of Reference Cited in the Office Action dated Dec. 19, 2006 issued by USPTO for U.S. Appl. No. 10/767,716.

* cited by examiner

*Primary Examiner*—Lamson Nguyen
*Assistant Examiner*—Shelby Fidler
(74) *Attorney, Agent, or Firm*—Morgan & Finnegan, L.L.P.

(57) ABSTRACT

A printing apparatus for performing printing by scanning a carriage capable of mounting an inkjet printhead discharging ink where correction of printing timing is performed for adjusting printing positions in the printing, and information on the correction, which can be obtained when the correction is executed, is stored in non-volatile memory means.

10 Claims, 7 Drawing Sheets

PRINTING APPARATUS, PRINTING SYSTEM AND CONTROL METHOD FOR PRINTING APPARATUS

FIELD OF THE INVENTION

The present invention relates to a printing apparatus, a printing system, a control method of a printing apparatus, and a printer driver, and more particularly, to the control for performing printing by scanning a carriage being capable of mounting an inkjet printhead discharging ink.

BACKGROUND OF THE INVENTION

A printing apparatus capable of printing desired information such as texts and images on a sheet-type printing medium, e.g., paper, film, and the like, is widely utilized as a data output apparatus in a word processor, a personal computer, a facsimile, and so forth.

Although various printing methods are available for such printing apparatus, recently an inkjet printing method has particularly attracted the attention because of its capability to perform non-contact printing on a printing medium such as paper, ease of color printing, and low noise. In general, a serial printing method is widely adopted because of its low cost and ease of downsizing. The configuration for the serial printing method includes a printing unit for reciprocally scanning a carriage incorporating a printhead discharging ink in accordance with desired printing data, and a conveyance unit for conveying a printing medium in a direction orthogonal to the scanning direction.

For improved printing speed, recently there are increasing numbers of printing apparatuses adopting the so-called bi-directional printing, in which printing is performed during the forward and backward scanning of the printing unit.

When printing, discharge timing should be corrected so that ink is discharged at the same position on a printing medium. For example, in a printing apparatus capable of bi-directional printing normally has a function for correcting ink discharge timing of the bi-directional printing so that ink is discharged at the same position on a printing medium in the forward and backward printing. By virtue of this correction function, excellent printing quality is ensured (refer to, e.g., Japanese Patent Application Laid-Open (KOKAI) No. 2001-129985). This document also discloses a typical correction method.

The ink discharge timing correction must mandatorily be performed before bi-directional printing. If the correction is not performed, intrinsic printing quality of the printer cannot be assured.

However, in reality, the printing apparatus is so constructed that printing is executable regardless of whether or not the ink discharge timing correction is performed for bi-directional printing.

There are some printer drivers which give a warning message to execute the ink discharge timing correction for bi-directional printing, when the printer driver is installed in an external host device. However, since installation of a printer driver is performed independently of the state of a printing apparatus, the warning message does not guarantee execution of the ink discharge timing correction.

SUMMARY OF THE INVENTION

The present invention has been proposed in view of the above-described situation. The object of the present invention is to prompt execution of the printing timing correction when printing is performed by a printing apparatus performing printing by scanning a carriage, and to enable printing with intrinsic printing quality of the printing apparatus.

In order to attain the above-object, according to one aspect of the present invention, there is provided a printing apparatus for performing printing by scanning a carriage being capable of mounting an inkjet printhead for discharging ink, comprising: correction means for performing correction of printing timing for adjusting a printing position in the printing; and nonvolatile storage means for storing information on whether the correction has been performed or not, which can be obtained when the correction is executed.

In other words, according to an inkjet printing apparatus of the present invention which performs printing by scanning a carriage being capable of mounting an inkjet printhead discharging ink, correction of printing timing is performed for adjusting a printing position in the printing, and information on whether the correction has been performed or not that can be obtained when the correction is executed is stored in non-volatile memory means.

By virtue of this configuration, every time a user designates printing in a host device, the host device requests the printing apparatus to transmit information on the correction has been performed or not. If the correction has not been performed, the host device displays a message to the user.

Therefore, it is possible to have a user perform correction of printing timing before the printing. As a result, printing can be performed with intrinsic printing quality of the printing apparatus, in which a deviation of printing positions in the scanning is corrected.

The information may include a correction value for discharge timing of ink.

In the case where the printing apparatus is adapted to perform printing by bi-directional scanning, the correction means may correct printing timing for scanning in a forward direction and printing timing for scanning in a backward direction.

Note that the present invention is applicable not only to the above-described printing apparatus, but also to a printing system, a control method of a printing apparatus, a printer driver, and a storage medium storing the printer driver.

Other features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In the following embodiments, an inkjet printing system, which includes a printing apparatus utilizing an inkjet printing method and a host device for the printing apparatus is explained as an example.

In this specification, "print" is not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

Figure 6:
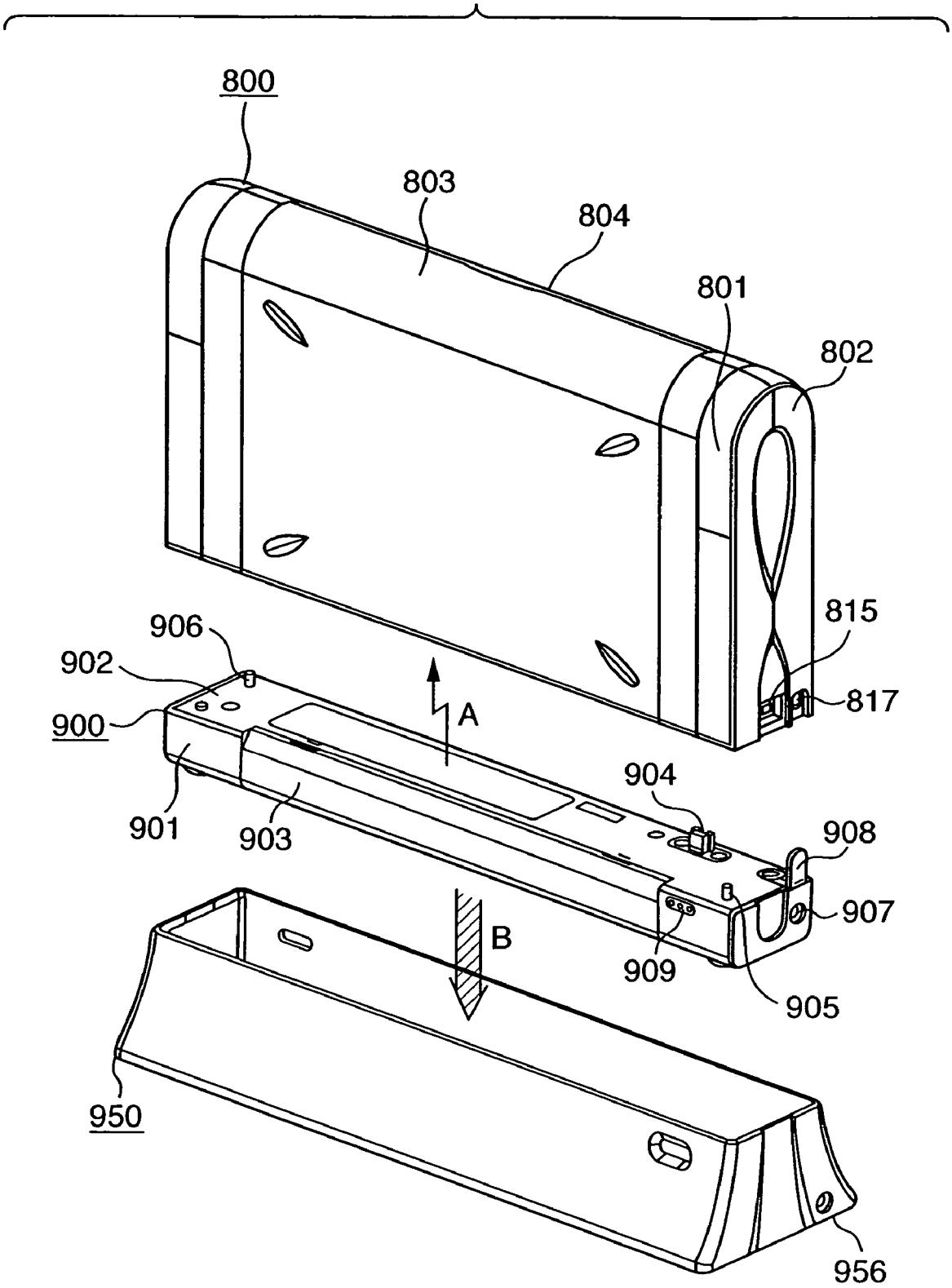
FIG. 6 is a perspective view showing an overall construction of an inkjet printer according to an embodiment.

FIG. 6 is a perspective view showing the overall arrangement of a printing apparatus according to an embodiment of the present invention. FIG. 6 shows an inkjet printer serving as a printing apparatus, a battery charger serving as a charging device which incorporates a battery and is detachable from the printer main body, and a cradle serving as a mount for vertically housing the printer and battery charger while attaching them. A paper sheet will be exemplified as a printing medium for printing by the inkjet printer. The present invention is not limited to this, and can be applied to any printable sheet-like medium.

In FIG. 6, the outer appearance of an inkjet printer 800 is an integral shell structure comprised of an upper case 801, lower case 802, feed cover 803, and feed port cover 804. The inkjet printer 800 takes this form when it is not used (stands still or is carried). The side surface of the inkjet printer 800 has a "DC in" jack (DC power input jack) 817 for inserting an AC adopter cable serving as a power supply, and an I/F connector (interface connector) 815 for connecting a USB cable. The feed cover 803 is a printing sheet supply tray which is opened from the printer main body to support a printing sheet such as a paper sheet in printing.

The outer appearance of a battery charger 900 is comprised of a main case 901, cover case 902, and battery lid 903. The battery lid 903 is detached to open the main case 901, allowing removing a battery pack serving as a battery charger.

The mounting surface (connection surface) of the battery charger 900 to the inkjet printer 800 has a main body connector 904 for electrical connection, and fixing screws 905 and 906 for mechanical attachment and fixing. The battery charger 900 is connected to the printer main body in a direction indicated by an arrow A in FIG. 6 to drive the printer by the battery. The top surface of the battery charger 900 has a charge indicator 909 which indicates the charging state of the battery. The side surface of the battery charger 900 has a "CHG-DC in" jack 907 for inserting an AC adopter cable serving as a power supply, and a cover plate 908 for covering the "DC in" jack 817 of the inkjet printer 800 when the battery charger 900 is attached.

A cradle 950 functions as a mount by inserting it in a direction indicated by an arrow B in FIG. 6 while the battery charger 900 is attached to the inkjet printer 800.

Figure 7:
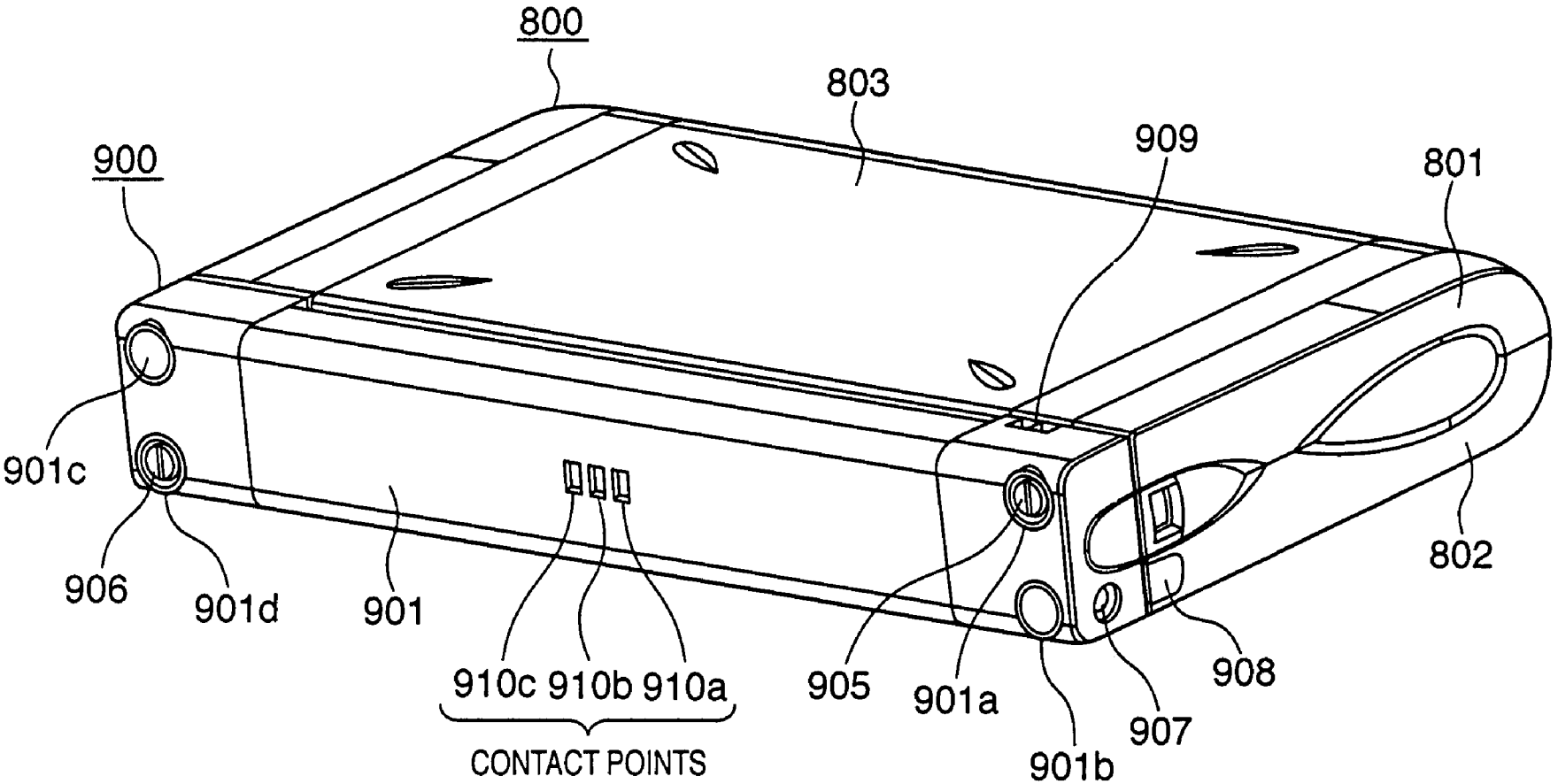
FIG. 7 is a perspective view showing a state where a battery charger is mounted to the inkjet printer shown in FIG. 6.

FIG. 7 is a perspective view showing a state in which the battery charger 900 is mounted on the inkjet printer 800 when the printer back surface and printer top surface are viewed diagonally from the top.

As shown in FIG. 7, the battery charger 900 is attached to the back surface of the inkjet printer 800, and fixed with the fixing screws 905 and 906 to implement a battery-driven printer.

As described above, the "DC in" jack 817 of the inkjet printer 800 is covered with the cover plate 908 of the battery charger 900. In attaching the battery charger 900, the user reliably inserts the AC adopter cable to the "CHG-DC in" jack 907 of the battery charger 900, thus preventing erroneous insertion.

The back surface of the battery charger 900 has four legs 901*a*, 901*b*, 901*c*, and 901*d* on the main case 901. This back surface also has contacts 910*a*, 910*b*, and 910*c* for electrical contact upon attachment to the cradle 950.

As shown in FIG. 7, the charge indicator 909 of the battery charger 900 is arranged at a position where, even when the feed cover 803 is opened, the feed cover 803 does not interrupt visual recognition on the top surface on which the charge indicator 909 can be easily visually recognized in mounting or using the inkjet printer 800.

Figure 1:
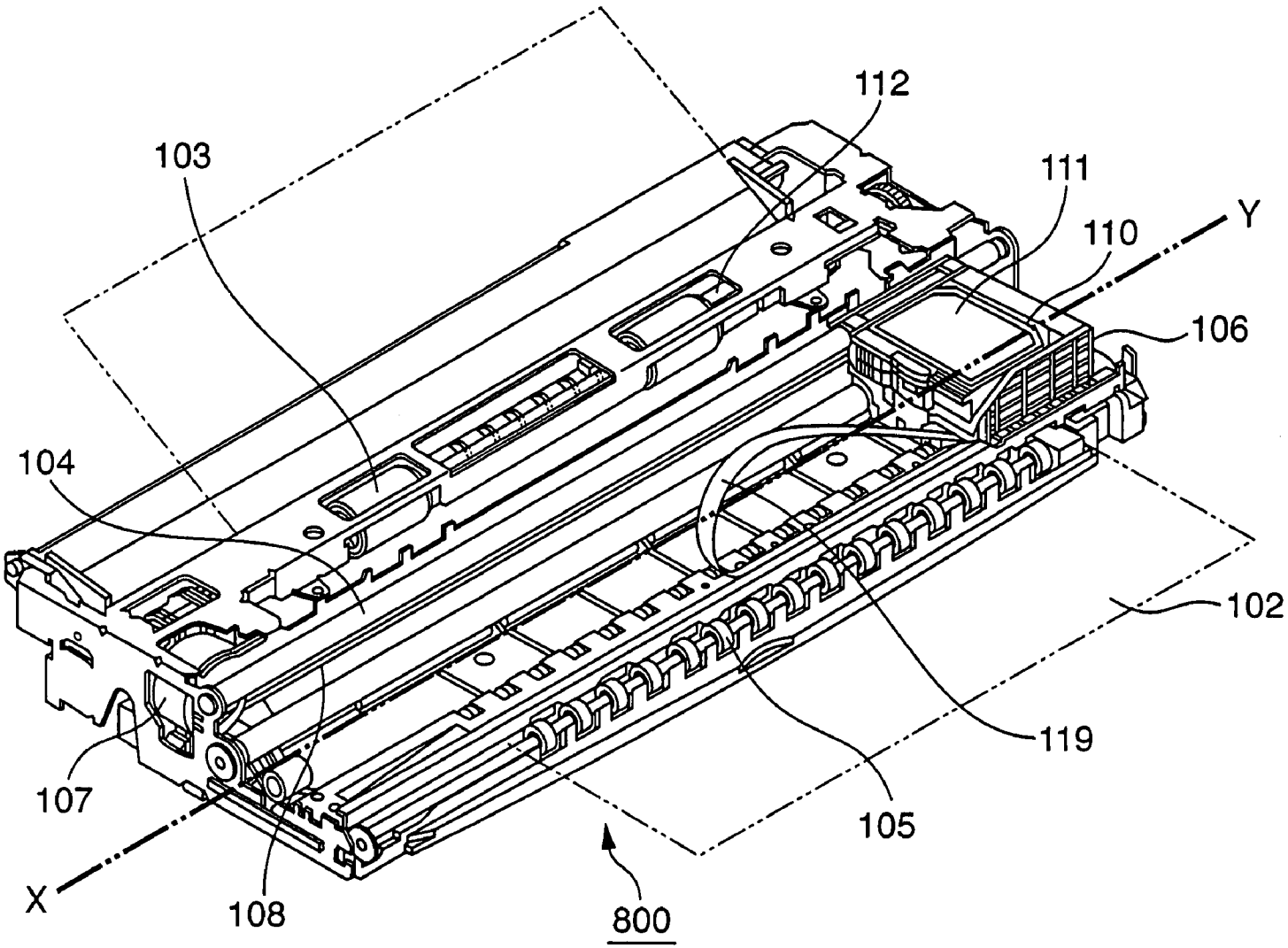
FIG. 1 is a perspective view showing an outer appearance of a printing apparatus according to an embodiment.

FIG. 1 is a perspective view showing an outer appearance of an inkjet printing apparatus. An inkjet printing apparatus 800 performs a printing operation by driving various mechanical parts shown in the drawing. A paper sheet 102 serving as a printing medium is inserted to the printer main body by a pickup roller 103, conveyed to a predetermined paper-feed position, then conveyed to a predetermined printing position inside the printer by a conveyance roller 104 to be subjected to a printing operation, and outputted by a discharge roller 105.

While the paper sheet 102 is conveyed, a carriage 106 incorporating a printhead cartridge 110 serving as a printing unit of the printer is driven by a carriage driving belt 108 which transmits power from a carriage driving motor 107, to scan over the paper sheet. In synchronization with the carriage motion, a driving signal and a control signal are transmitted from a flexible cable 109 to the printhead cartridge 110. In accordance with the signals, ink supplied from an ink tank 111 is discharged to the paper sheet 102, thereby performing printing.

While paper feeding operation is performed by rotating the pickup roller 103, a sensor 112 which detects a paper edge determines existence or absence of a paper sheet. By the detection of the sensor 112, the internal position of the paper sheet is also controlled. The paper sheet, conveyed to the predetermined printing position by the conveyance roller 104, is conveyed also by the driving force of the discharge roller 105.

Figure 2:
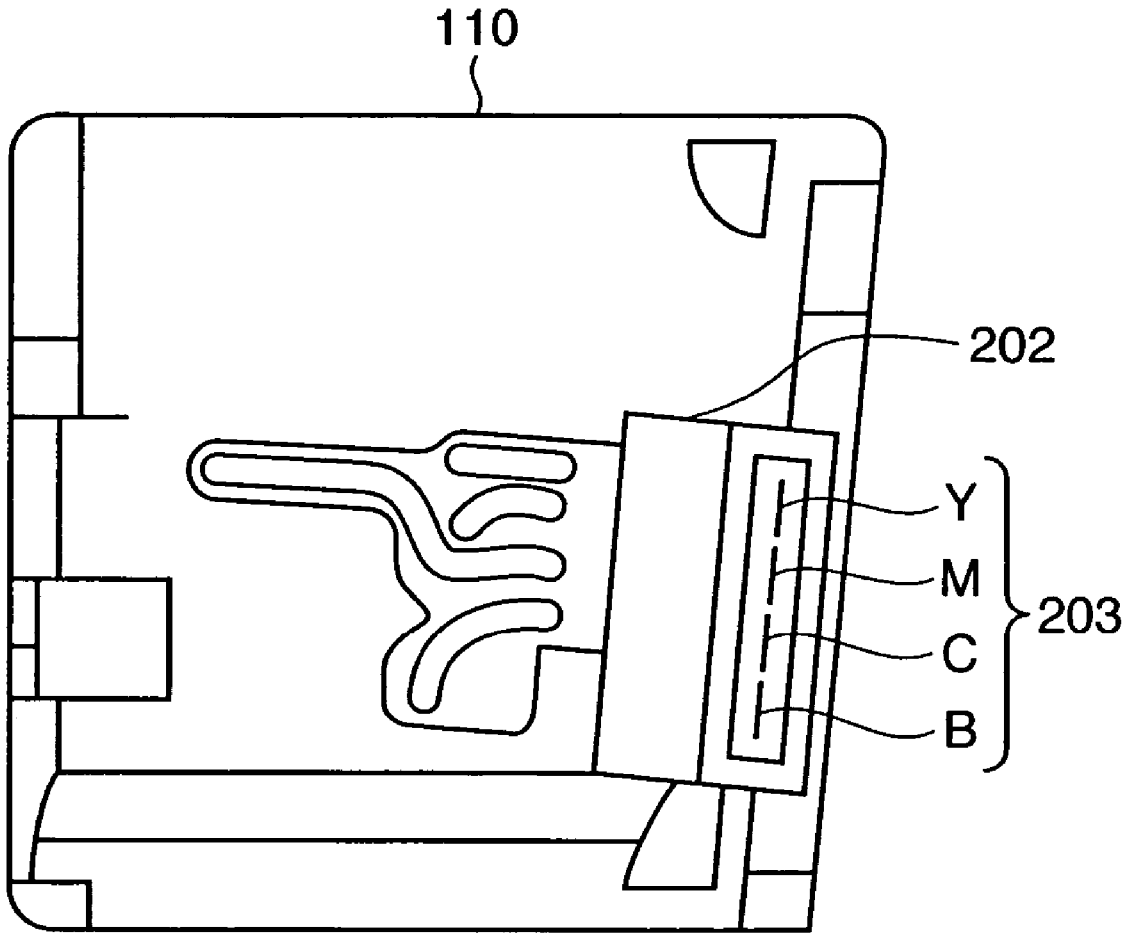
FIG. 2 is a view of a printhead cartridge shown in FIG. 1, which is seen from the printing surface of a paper sheet.

FIG. 2 is a view of the printhead cartridge 110 shown in FIG. 1, which is seen from the printing surface of the paper sheet.

The printhead cartridge 110 comprises a nozzle unit 202 for discharging ink. The nozzle unit 202 has discharge orifices 203 for discharging yellow (Y), magenta (M), cyan (C), and black (B) inks respectively. The ink of respective colors is discharged from the orifices to the paper sheet, thereby forming a desired image. In other words, each of the nozzles discharging ink serves as a printing element.

For an ink discharging method, a method utilizing heat energy, a method utilizing a piezoelectric device, and the like are known. Any of these methods may be adopted.

Figure 3A:
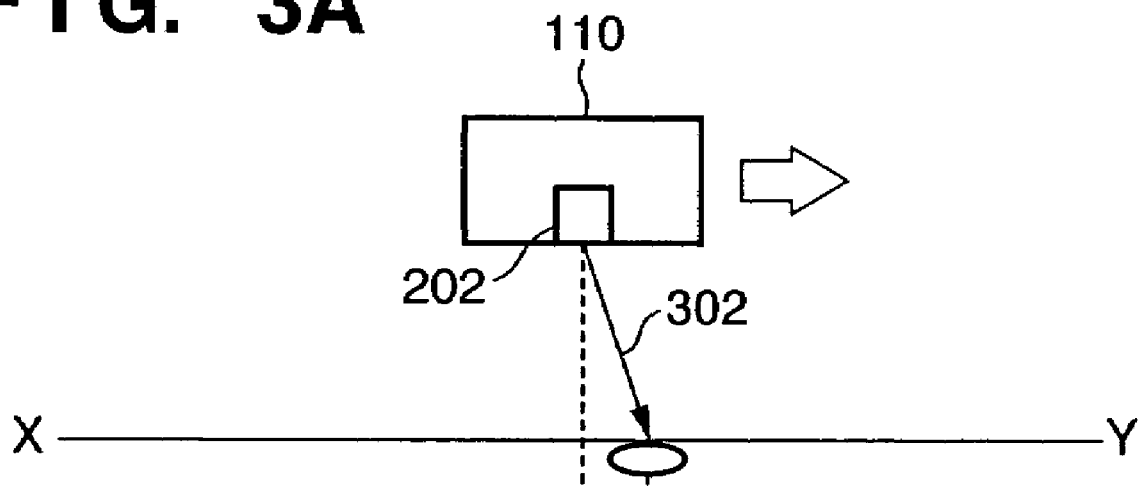
FIGS. 3A and 3B are explanatory views of an ink discharge state in bi-directional printing, which are seen from the X-Y cross-section in FIG. 1.
Figure 3B:
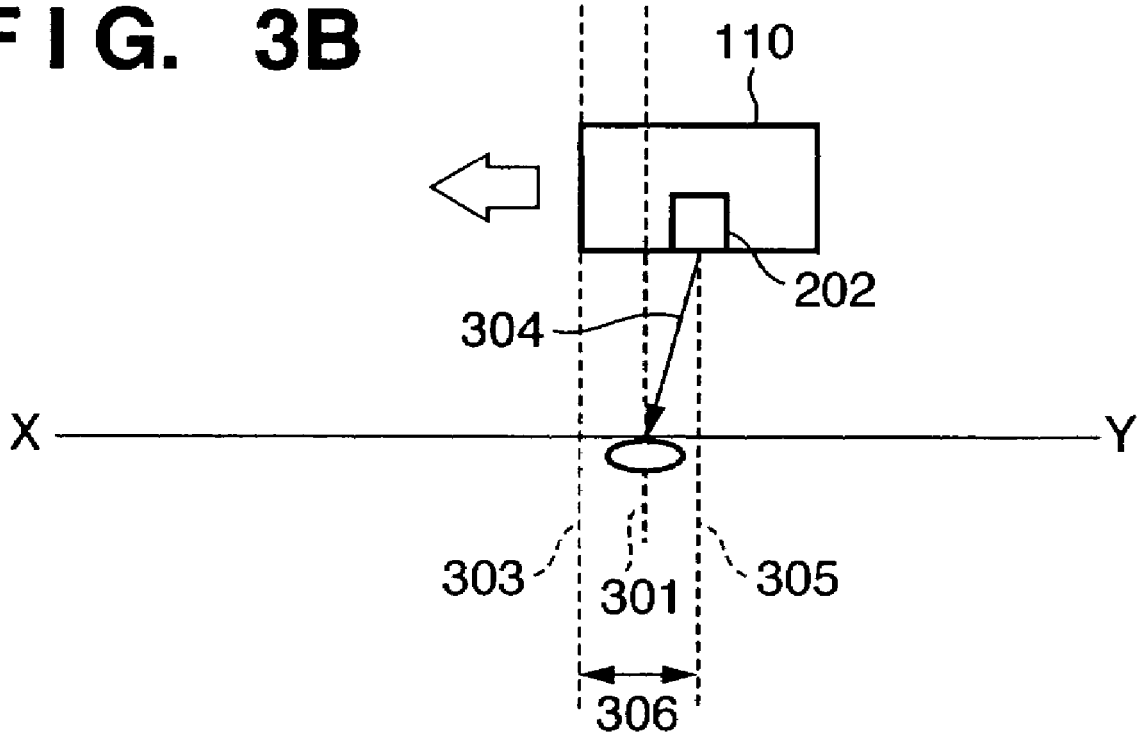

FIGS. 3A and 3B are explanatory views of an ink discharge state seen from the X-Y cross-section in FIG. 1, when bi-directional printing is performed according to this embodiment.

FIG. 3A shows a case where the printhead cartridge 110 is scanned from X to Y in the forward direction. FIG. 3B shows a case where the printhead cartridge 110 is scanned from Y to X in the backward direction. The line X-Y in FIGS. 3A and 3B indicates the printing surface.

When the printhead cartridge 110 is scanned at predetermined speed, ink discharged from the discharge nozzle unit 202 has a velocity vector 302 or 304, which is the composition of the discharge speed toward the printing surface and the speed toward the scanning direction. To land ink at the desired landing position 301, in the case of the forward scanning shown in FIG. 3A, it is necessary to discharge ink when the nozzle unit 202 facing the printing surface is at the position 303 in the scanning direction. In the case of the backward scanning shown in FIG. 3B, it is necessary to discharge ink when the nozzle unit 202 facing the printing surface is at the position 305 in the scanning direction.

As described above, when bi-directional printing is performed, there is a difference, represented by the distance 306, in the ink discharge position between forward scanning and backward scanning. To perform high-quality printing, it is necessary to calculate the distance 306 as a correction value and correct the ink discharge timing in the forward path and backward path.

Note that the correction method of ink discharge timing is not limited to a particular method in this embodiment. For instance, a method proposed by the aforementioned document (Japanese Patent Application Laid-Open (KOKAI) No. 2001-129985) may be employed.

Figure 4:
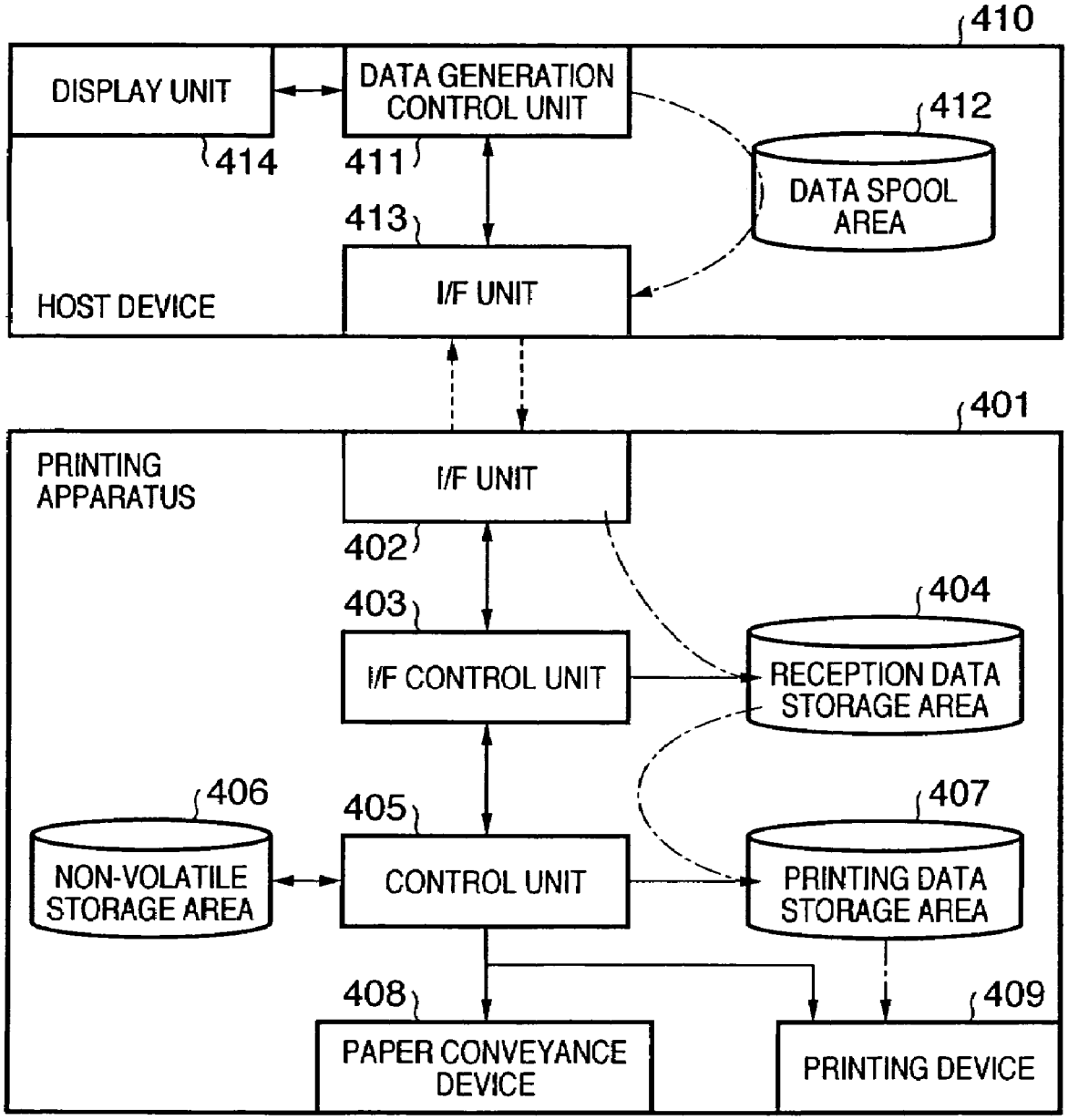
FIG. 4 is a block diagram showing an internal construction of an inkjet printing apparatus and a host device.

FIG. 4 is a block diagram showing an internal construction of the inkjet printing apparatus and a host device according to this embodiment.

An inkjet printing apparatus 401 performs data reception through an I/F unit 402 which inputs or outputs data from or to an external unit, an I/F control unit 403 which controls the I/F unit 402, and a reception data storage area 404 which stores data received through the I/F unit. A control unit 405, which controls the entire apparatus, generates printing data based on the data stored in the reception data storage area 404, and the generated printing data is stored in a printing data storage area 407. Also, the control unit 405 controls a paper conveyance device 408 and a printing device 409 including a printhead to execute printing on a paper sheet.

When the inkjet printing apparatus performs correction of ink discharge timing, it also stores information indicating that correction has been performed as well as the correction value of ink discharge timing in the non-volatile storage area 406.

Although this embodiment gives as an example the information indicating that the correction has been performed, the information may be of data indicative of the state of correction, or may be of information indicating that correction has not been performed. In this case, the control is changed accordingly.

Meanwhile in a host device 410, a printer driver for the inkjet printing apparatus 401 is installed. When a printing operation is designated by an application program, the printer driver executes the process which will be described later to perform printing. More specifically, printing data is generated by a data generation control unit 411, the generated printing data is temporarily stored in a spool area 412 and transmitted to the inkjet printing apparatus 401 through an I/F unit 413. Information from the inkjet printing apparatus 401 is transmitted from the I/F unit 402 to the I/F unit 413 of the host device. information or warning for a user is displayed on a display unit 414 by the data generation control unit 411.

The connection between the inkjet printing apparatus 401 and the host device 410 may be realized with wires or without wires, as long as data transmission/reception is realized between the I/F units of these apparatuses.

Figure 5:
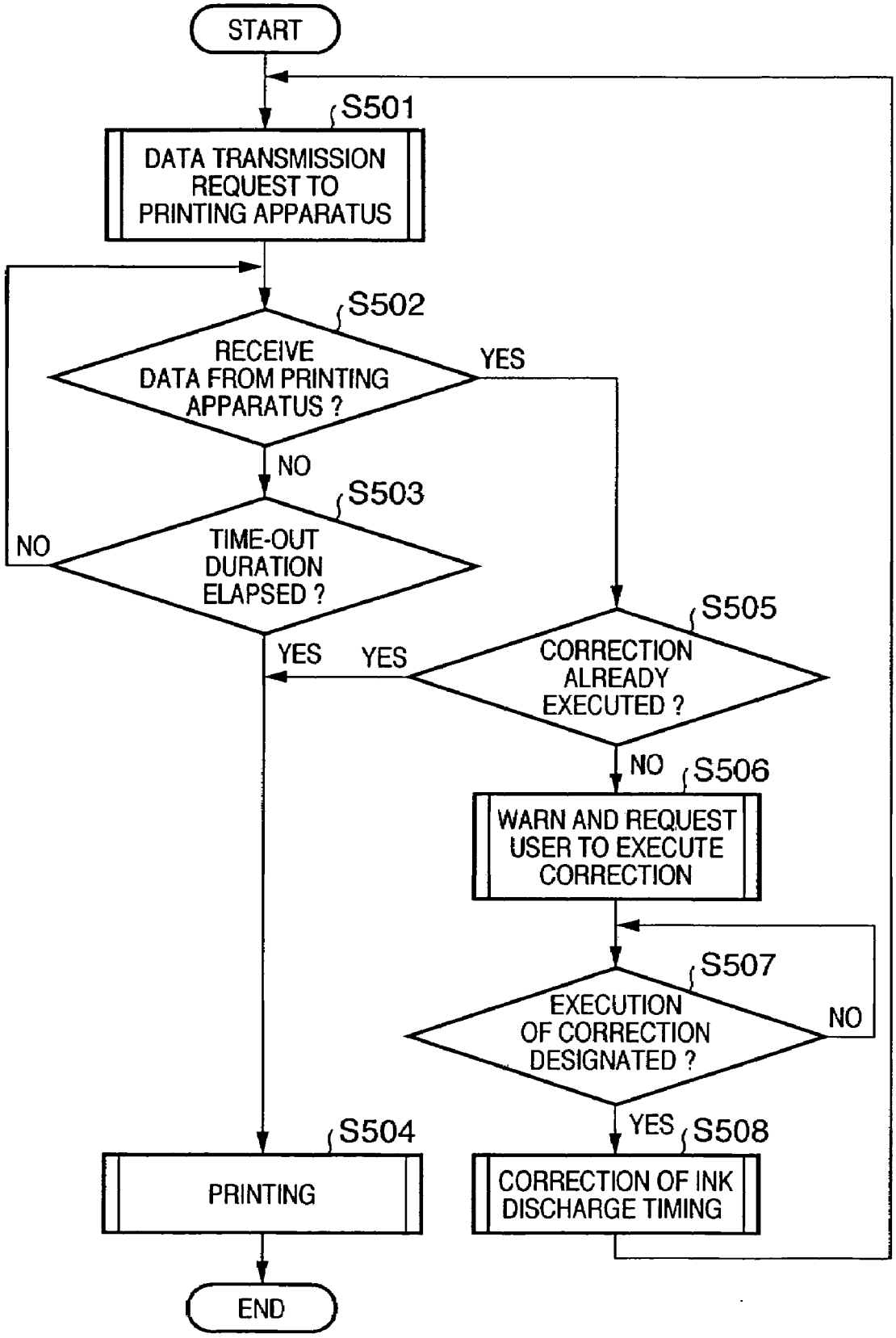
FIG. 5 is a flowchart describing a process executed when printing is designated in a host device.

FIG. 5 is a flowchart describing a process executed by the printer driver when printing is designated in the host device according to the present embodiment.

When printing is designated by an application program operating in the host device, the printer driver first requests the inkjet printing apparatus to transmit information related to the correction of ink discharge timing (a correction value of ink discharge timing and information indicative of whether or not correction has been performed) (step S501). Then it is determined whether or not the printer driver has received the information from the printing apparatus (step S502). If the information has not been received, it is determined whether or not a predetermined time-out duration has elapsed (step S503). If the time-out duration has not elapsed, the control returns to step S502. If the time-out duration has elapsed, printing is executed regardless of whether or not the information has been received from the printing apparatus (step S504).

If it is determined in step S502 that the printer driver has received the information from the printing apparatus, it is determined whether or not ink discharge timing correction has been performed (step S505). If ink discharge timing correction has already been performed, printing is executed immediately (step S504). Meanwhile, if it is determined that ink discharge timing correction has not been performed, a message is displayed by the display unit to warn the user that ink discharge timing correction has not been performed and request execution of the correction (step S506).

In this case, the printer driver holds the standby state until the user designates execution of the ink discharge timing correction (step S507). When execution of the ink discharge timing correction is designated by the user, the ink discharge timing correction is executed (step S508). To reflect the result of ink discharge timing correction (correction value) on printing, the control returns to step S501, and information related to the ink discharge timing correction is requested to the printing apparatus.

As described above, according to this embodiment, every time a user designates printing, the printing apparatus is requested to transmit information related to ink discharge timing correction. If the correction has not been performed, execution of ink discharge timing correction is requested.

Accordingly, it is possible to have a user perform ink discharge timing correction before bi-directional printing. As a result, printing can be performed with intrinsic printing quality of the printing apparatus, in which a deviation of printing positions in the forward and backward scanning of the bi-directional printing is corrected.

Modified Embodiment

The above embodiment assumes that an inkjet printing apparatus always performs bi-directional printing. In a case where a printing apparatus includes a printing mode for one-directional printing and a printing mode for bi-directional printing, the process shown in the flowchart in FIG. 5 is performed only when the printing mode for bi-directional printing is set.

In the above embodiment, the information related to ink discharge timing correction is used to determine whether or not correction has been performed and to obtain a correction value of ink discharge timing. Alternatively, for instance, an unrealistic correction value may be set as an initial value in the printing apparatus to indicate that ink discharge timing correction has not been performed yet. In this case, the information related to ink discharge timing correction only includes a correction value of ink discharge timing.

Other Embodiments

The present invention can be applied to a system comprising a plurality of devices or to an apparatus comprising a single device.

Furthermore, the invention can be implemented by supplying a software program, which implements the functions of the foregoing embodiments (such as a printer driver corresponding to the flow-chart shown in FIG. 5), directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or scrip data supplied to an operating system.

Example of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby. the program is installed in the user computer.

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

If the present invention is realized as a storage medium, program codes corresponding to the above mentioned flowcharts (FIG. 1 and/or FIG. 2) are to be stored in the storage medium.

As many apparently widely different embodiments of the present invention can be made without departing from the spirit and scope thereof, it is to be understood that the invention is not limited to the specific embodiments thereof except as defined in the appended claims.

What is claimed is:

1. An inkjet printing apparatus capable of performing both a one-directional and a bi-directional printing modes by scanning a carriage at forward and backward directions on a recording medium, comprising:

non-volatile storage means for storing a correction value and information designating whether correction is performed or not;

correction means for performing the correction in accordance with the correction value;

printing means for performing printing in accordance with a print command from a host device;

receiving means for receiving a request from the host device;

transfer means for transferring the correction value and the information to the host device based on the request; and control means for controlling, in case of the bi-directional printing mode, the transfer means to transfer the correction value and the information to the host device when the receiving means receives the request from the host device, the correction means to perform the correction when the receiving means receives a correction command from the host device, and the printing means to perform the bi-directional printing, and for controlling, in case of a one-directional printing mode, the printing means to perform the one-directional printing when received the print command from the host device without transferring the correction value and the information to the host device when the receiving means receives the request from the host device and without performing the correction when the receiving means receives a correction command from the host device.

2. The inkjet printing apparatus according to claim 1, wherein said transfer means transfers again the correction value applied to the correction upon request from the host device after the correction means performs the correction.

3. A printing system including a printing apparatus performing a one-directional and a bi-directional printing modes by scanning a carriage at forward and backward directions on a recording medium and a host device connected to the printing apparatus, wherein said printing apparatus comprises;

non-volatile storage means for storing a correction value and information designating whether correction is performed or not;

correction means for performing the correction in accordance with the correction value;

printing means for performing printing in accordance with a print command from the host device;

receiving means for receiving a request from the host device;

transfer means for transferring the correction value and the information to the host device; and control means for controlling, for controlling, in case of the bi-directional printing mode, the transfer means to transfer the correction value and the information to the host device when the receiving means receives the request from the host device, the correction means to perform the correction when the receiving means receives a correction command from the host device, and the printing means to perform printing, and in case of the one-directional printing mode, the printing means to perform printing when received the print command from the host device without transferring the correction value and the information to the host device when the receiving means receives the request from the host device and without performing the correction when the receiving means receives a correction command from the host device, and wherein said host device commands the printing apparatus to immediately perform the one-directional printing in accordance with a print instruction in case of the one-directional printing mode; and said host device, in case of the bi-directional printing mode, requests the correction value and the information to the printing apparatus, determines whether the correction is performed or not based on the requested information, and commands the printing apparatus to perform the correction if the correction is not performed, or commands the printing apparatus to perform the bi-directional printing if the correction is performed.

4. The printing system according to claim 3, wherein the host device further comprises: a timer for instructing the printing apparatus to perform the printing without the correction when said requested information is not received within a predetermined time.

5. The printing system according to claim 3, wherein the host device again requests the information to the printing apparatus after said correction.

6. The printing system according to claim 3, wherein the host apparatus displays a message when the correction is not performed.

7. A printing method for a printing system including a printing apparatus performing a one-directional and a bi-directional printing modes by scanning a carriage at forward and backward directions on a recording medium and a host device connected to the printing apparatus, wherein said printing apparatus comprises;

non-volatile storage means for storing a correction value and information designating whether correction is performed or not;

correction means for performing the correction in accordance with the correction value;

printing means for performing printing in accordance with a print command from the host device;

receiving means for receiving a request from the host device;

transfer means for transferring the correction value and the information to the host device; and control means for controlling, in case of the bi-directional printing mode, the transfer means to transfer the correction value and the information to the host device when the receiving means receives the request from the host device, the correction means to perform the correction when the receiving means receives a correction command from the host device, and the printing means to perform printing, in case of the one-directional printing mode, the printing means to perform printing when received the print command from the host device without transferring the correction value and the information to the host device when the receiving means receives the request from the host device and without performing the correction when the receiving means receives a correction command from the host device, and wherein the printing method comprising the steps of;

commanding by said host device the printing apparatus to immediately perform the one-directional printing in accordance with a print instruction in case of the one-directional printing mode; and requesting by said host device, in case of the bi-directional printing mode, the correction value and the information to the printing apparatus, determining whether the correction is performed or not based on the requested information, and commanding the printing apparatus to perform the correction if the correction is not performed, or commanding the printing apparatus to perform the bi-directional printing if the correction is performed.

8. The printing method according to claim 7, further comprising the step of:

measuring a time for instructing the printing apparatus to perform the printing without the correction when said requested information is not received within a predetermined time.

9. The printing method according to claim 7, further comprising the step of: requesting again the information to the printing apparatus after said correction.

10. The printing method according to claim 7, further comprising the step of: displaying a message when the correction is not performed.

* * * * *

UNITED STATES PATENT AND TRADEMARK OFFICE

CERTIFICATE OF CORRECTION

PATENT NO. : 7,303,245 B2
APPLICATION NO. : 10/769372
DATED : December 4, 2007
INVENTOR(S) : Kunihiro It is certified that error appears in the above-identified patent and that said Letters Patent is hereby corrected as shown below:

On the Title Page, under "(22) Filed:" change "Jan. 29, 2004" to --Jan. 30, 2004--;

In Column 9, Line 9, delete the second occurrence of "for controlling,"; and

In Column 10, Line 30, delete "immediately".

Signed and Sealed this

Twentieth Day of May, 2008

JON W. DUDAS
*Director of the United States Patent and Trademark Office*